US010413837B2

(12) United States Patent
Pance et al.

(10) Patent No.: US 10,413,837 B2
(45) Date of Patent: Sep. 17, 2019

(54) SYSTEMS OF STRONGLY COUPLED YO-YOS

(71) Applicant: Kristi Pance, Auburndale, MA (US)

(72) Inventors: Kristi Pance, Auburndale, MA (US); Martin Pance, Auburndale, MA (US)

(73) Assignee: Kristi Pance, Auburndale, MA (US)

( * ) Notice: Subject to any disclaimer, the term of this patent is extended or adjusted under 35 U.S.C. 154(b) by 0 days.

(21) Appl. No.: 15/235,345

(22) Filed: Aug. 12, 2016

(65) Prior Publication Data

US 2017/0136374 A1 May 18, 2017

Related U.S. Application Data

(60) Provisional application No. 62/255,445, filed on Nov. 14, 2015.

(51) Int. Cl.
*A63H 1/30* (2006.01)

(52) U.S. Cl.
CPC ..... *A63H 1/30* (2013.01)

(58) Field of Classification Search
USPC ..... 242/587, 587.1, 587.2, 587.3
See application file for complete search history.

(56) References Cited

U.S. PATENT DOCUMENTS 1,281,832 A * 10/1918 Post ..... A63H 33/105 446/112
1,311,534 A * 7/1919 Seymour ..... A63H 1/30 446/250
1,780,385 A * 11/1930 Guyot ..... A63H 1/30 446/248
1,854,876 A * 4/1932 Anzalone ..... A63H 1/32 446/253
2,380,301 A * 7/1945 Gavriles ..... A63H 1/30 446/250
3,175,326 A * 3/1965 Isaacson ..... A63H 1/30 446/250

(Continued)

FOREIGN PATENT DOCUMENTS

CN 201537385 U * 8/2010
CN 201537385 U 8/2010
KR 20000000168 U * 1/2000

OTHER PUBLICATIONS

English machine translation of CN-201537385-U (Year: 2019).*

(Continued)

*Primary Examiner* — John E Simms, Jr.
*Assistant Examiner* — Urszula M Cegielnik

(57) ABSTRACT

A system of strongly coupled multiple Yo-Yos in series is disclosed in which very string that connects the successive Yo-Yos may be wrapped around Yo-Yos respective axles and therefore can be wound or unwound on both ends at the same time. Accordingly, both ends of the strings and their respective Yo-Yos may move with different speeds and accelerations. Yo-Yos in the system have a modular structure. The system also can be constructed with modular pieces to provide different operating modes when is set in motion. In embodiments, the Yo-Yos may be connected via the return strings. To ensure the Yo-Yo sides remain with equal length during the operation, a regulating mechanism is provided, and a regulating ring to keep the two sides of the return string in proximity, and assuring a long operation.

20 Claims, 8 Drawing Sheets

(56) References Cited

U.S. PATENT DOCUMENTS 3,228,140 A * 1/1966 White ..... A63H 1/30 446/250
3,899,849 A * 8/1975 Witiak ..... A63H 1/30 446/137
3,936,974 A * 2/1976 House ..... A63H 1/00 446/250
4,290,225 A 9/1981 MacCarthy
4,318,243 A 3/1982 MacCarthy
4,602,783 A * 7/1986 Foland ..... A63H 1/32 482/139
5,470,269 A * 11/1995 Ambroz ..... A63H 1/30 446/250
D365,372 S * 12/1995 Churchman ..... D21/464
5,628,667 A * 5/1997 Levi ..... A63H 11/12 446/278
6,110,004 A * 8/2000 McKinley ..... A63H 33/00 434/302
6,220,920 B1 * 4/2001 Baier ..... A63H 1/30 446/249
6,406,082 B1 * 6/2002 Telfer ..... E01H 1/1206 294/1.3
7,419,417 B1 * 9/2008 VanKuiken ..... A63H 1/30 446/250
2007/0099534 A1 * 5/2007 Alas ..... A63H 33/00 446/5
2013/0045658 A1 * 2/2013 Amaral ..... A63H 1/30 446/236
2015/0075299 A1 * 3/2015 Riess ..... G01N 1/02 73/863.21

OTHER PUBLICATIONS

English machine translation of KR-20000000168-U (Year: 2019).*
PCT/US2016/046708, "Application Serial No. PCT/US2016/046708, International Search Report and Written Opinion dated Oct. 26, 2016", 10 pages.

* cited by examiner $$\begin{pmatrix} 1 & -1 & M_1 & 0 \\ 0 & 1 & 0 & M_2 \\ r_1^2 & -r_1^2 & I_1 & 0 \\ 0 & -r_2^2 & 0 & I_2 \end{pmatrix} \circ \begin{pmatrix} T_1 \\ T_2 \\ a_1 \\ a_2 \end{pmatrix} = \begin{pmatrix} M_1 g \\ M_2 g \\ 0 \\ 0 \end{pmatrix}$$

SYSTEMS OF STRONGLY COUPLED YO-YOS

RELATED APPLICATIONS

The present application claims priority to the following provisional application, which is hereby incorporated by reference in its entirety: Prov. Appl. 62/255,445, filed Nov. 14, 2015, entitled Systems of Strongly Coupled Yo-Yos.

BACKGROUND

Field of the Invention

The methods and systems disclosed herein generally relate to the field of interacting oscillators, and more specifically the field of interacting or coupled Yo-Yos in a series.

Description of the Related Art

The first Yo-Yo patent was filed on 1866 by Haven & Hettrich U.S. Pat. No. 59,745. Since then there have been almost 250 patents for different realizations. Most of the patents cover Yo-Yo's of different shape and ornaments. In the prior art the toy has been referred as disc, incroyable, bandalore, return top, and emigrette. The standard Yo-Yo consists of two parallel discs connected by an axle at their center. One end of the string is connected to the axle between the discs. The other end of the string is held by the user's hand. When up and down motion of the hand is initiated the string is wrapped or unwrapped around the axle. The string tension force and the weight of the two discs cause the rotational and translational motion of Yo-Yo. The total energy of the Yo-Yo can be separated in rotational kinetic energy, translational kinetic energy and potential energy. Rotational energy in particular helps to preserve the rotational plane of the Yo-Yo. A skilled operator knows how to enhance and control the rotational motion around the axle and avoid the precession around the vertical axis. It is the latest that can cause the Yo-Yo to stop eventually.

The modifications introduced to date on conventional Yo-Yos can be separated into three groups: In the first group are included aesthetic modifications of Yo-Yo disks shapes, different ornaments attached to them and any other addition that doesn't have an effect on Yo-Yo operation. In this group can also be included electronics, light effects and their interplay with rotational motion. In the second group are included the modifications that improve the Yo-Yo stability via rotational-favored shapes, weight distribution and the like. In the third group can be included the modifications that aim to add new functions and operating modes. The addition of bearing rings at axle-string contact, string separators for multiple return and the like can be included within this group. However, these mentioned developments are mere modifications and extensions of the same basic Yo-Yo apparatus long in existence.

Therefore, there exists a need for a system and method for Yo-Yos with structural enhancements impacting the function and physical motion of a Yo-Yo, and a plurality of Yo-Yos operating in conjunction with one another.

SUMMARY

Provided herein are methods and systems of Yo-Yos comprising a first Yo-Yo having a first disk, a second disk, third disk, and a fourth disk, the first, second, third and fourth disks being spaced apart from one another by a first axle segment, a second axle segment and a third axle segment; a second Yo-Yo having a first disk and a second disk separated by a central axle segment, the second Yo-Yo is spaced apart from the first Yo-Yo; a first string having a first end and a second end, the first end coupled to the first axle segment of the first Yo-Yo and the second end is coupled to the third axle segment, wherein a portion of the first string between the first end and the second end is configured to be held by a user; and a second string having a first end and second end, the first end of the second string is coupled to the second axle segment of the first Yo-Yo and the second end of the second string is coupled to the central axle segment of the second Yo-Yo, wherein the first string and the second string are coupled to first and second Yo-Yos so that the first and second Yo-Yos may rotate to cause linear and angular movement.

In embodiments, the first string may be wrapped around the first axle segment and the third axle segment, and the first end of the second string may be wrapped around the second axle segment of the first Yo-Yo and the second end of the second string is wrapped around the central axle segment of the second Yo-Yo.

In embodiments, the movement of the first and second Yo-Yos may occur simultaneously.

In embodiments, a length of the first and second strings may be equal.

In embodiments, a length of the first string may be greater than the second string.

In embodiments, a weight of the first and second Yo-Yos may be equal.

In embodiments, the weight of the first Yo-Yo may be greater than the second Yo-Yo.

In embodiments, the acceleration and rotational velocity of the first, and second Yo-Yos may be different.

Provided herein are methods and systems of of-Yo-Yos comprising a first Yo-Yo having a first disk, a second disk, third disk, and a fourth disk, the first, second, third and fourth disks being spaced apart from one another by a first axle segment, a second axle segment and a third axle segment; a second Yo-Yo having a first disk, second disk, and a third disk separated by a first axle segment, and a second axle segment, wherein the second Yo-Yo is spaced apart from the first Yo-Yo; a first string having a first end and a second end, the first end of the first string is coupled to the first axle segment of the first Yo-Yo and the second end is coupled to the first axle segment of the second Yo-Yo; a second string having a first end and second end, the first end of the second string is coupled to the third axle segment of the first Yo-Yo and the second end of the second string is coupled to the second axle segment of the second Yo-Yo; and a third string having a first end and second end, the first end of the third string is coupled to the second axle segment of the first Yo-Yo and the second end of the third string is a free end adapted to be held by a user.

Provided herein are methods and systems of Yo-Yos comprising a first Yo-Yo having a first disk, a second disk, third disk, and a fourth disk, the first, second, third and fourth disks being spaced apart from one another by a first axle segment, a second axle segment and a third axle segment; a second Yo-Yo having a first disk, a second disk, third disk, and a fourth disk, the first, second, third and fourth disks being spaced apart from one another by a first axle segment, a second axle segment and a third axle segment, the second Yo-Yo is spaced apart from the first Yo-Yo; a third Yo-Yo having a first disk and a second disk separated by a central axle segment, the third Yo-Yo is spaced apart from the second Yo-Yo; a first string having a first end and a second end, the first end coupled to the first axle segment of the first Yo-Yo and the second end is coupled to the first axle segment of the second Yo-Yo; a second string having a first end and a second end, the first end coupled to the third axle segment of the first Yo-Yo and the second end is coupled to the third axle segment of the second Yo-Yo; a third string having a first end and a second end, the first end coupled to the second axle segment of the first Yo-Yo and the second end is a free end configured to be held by a user; and a fourth string having a first end and a second end, the first end of the fourth string coupled to the central axle segment of the third Yo-Yo and the second end of the fourth string is coupled to the second axle segment of the second Yo-Yo.

Provided herein are methods and systems of Yo-Yo comprising a first disk, a second disk, third disk, and a fourth disk, the first, second, third and fourth disks being spaced apart from one another by a first axle segment, a second axle segment and a third axle segment; a hollow cylindrical axle extending from the first disk to the fourth disk; and a string adapted to extend through an opening on the surface of the first axle segment extending though the hollow cylindrical axel through an opening on the surface of the third axle segment.

These and other systems, methods, objects, features, and advantages of the present disclosure will be apparent to those skilled in the art from the following detailed description of the preferred embodiment and the drawings. All documents mentioned herein are hereby incorporated in their entirety by reference.

BRIEF DESCRIPTION OF THE FIGURES

The disclosure and the following detailed description of certain embodiments thereof may be understood by reference to the following figures.

DETAILED DESCRIPTION

Figure 1A:
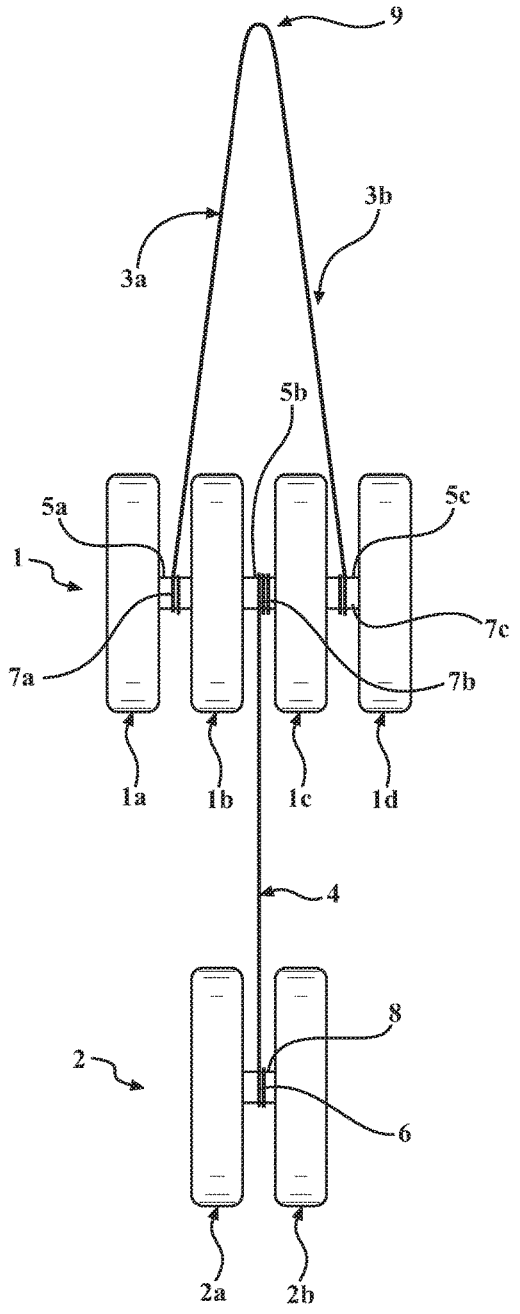
FIG. 1A is a front view of a preferred embodiment of the invention that shows the system of two coupled Yo-Yos. The first Yo-Yo is unconventional with two more string separators to accommodate a return string. The top of the said string ends at the operator's hand. A conventional (standard) Yo-Yo is connected, to the first said Yo-Yo via a simple string with the other end wrapped to the central axle segment of the first Yo-Yo.

In embodiments of the present invention methods and systems of improved Yo-Yo function are presented, including but not limited to an embodiment of at least two strongly coupled Yo-Yos. An operator through his hand's upward and downward motion, may control the motion of the second Yo-Yo through the first. The string that connects the two Yo-Yos may be wrapped or unwrapped on both ends simultaneously.

In embodiments, the methods and systems of the present invention may consist of multiple Yo-Yos in series, connected through strings that may be wound or unwound in the same or opposite directions around the Yo-Yo axles and may strongly affect the motion of each other. In one operating mode, the Yo-Yos may be prevented from rotating independently. However, for limited time intervals different Yo-Yos in the system may be adjusted to rotate independently, and a Yo-Yo in the system may be set to rotate in a "sleeping mode". The system described herein, through designing and controlling the rotational motion of its different Yo-Yos, may provide extra stability. By balancing the length and the winding speed of multiple return strings, the Yo-Yos precession around the vertical axis may be minimized.

In embodiments, multi return strings between Yo-Yos may be used. In another embodiment of the present invention, the coupling between Yo-Yos may be obtained through multi return strings and simple strings, and the mass distribution along the Yo-Yo axles may be modified via disks of different weights and/or by using single strings to connect the adjacent Yo-Yos. Yo-Yos in the system described herein may have a modular structure. The system also can be put together with modular pieces to provide different operating modes when is set in motion. The system may also operate as a mechanical filter. The driving oscillatory motion with a frequency that is provided by the ups and downs of the operator hand may be transferred sequentially to the coupled resonators or oscillators, which are the coupled Yo-Yos. The frequencies that coincide with the intrinsic frequencies of the coupled Yo-Yos or the so-called eigen-frequencies are accepted and therefore, can be transferred. These physical rotational oscillatory eigen-frequencies depend on Yo-Yos moment of inertia, their frictions with the strings and string tensions. The rest of the frequencies are rejected. In other words only some particular up and down frequencies of the operator hand can set and keep the system of the Yo-Yos in motion. Any other hand frequency that is higher or lower cannot. A skilled operator knows exactly the "bandwidths" around the Yo-Yo system rotational and oscillatory physical eigen-frequencies.

In embodiments of the present invention, an apparatus and system of multiple Yo-Yos may be connected by either a single or return strings that are wrapped around the axels of the said Yo-Yo's. The system of the multiple Yo-Yos, as described herein, may be set for a particular choice of Yo-Yo masses and string lengths and also a particular up and down frequency relative to the operator's hand, and may be tuned to determine a particular desired motion. In one embodiment, a Yo-Yo may consist of a system of two Yo-Yos. The first may be a standard Yo-Yo with a single string connected to its axel. The other end of the said string may be connected to the central axel segment of the second Yo-Yo. This central axel segment may be confined by two central string separators. The string may be wound or unwound at both ends. The second Yo-Yo may be an unconventional Yo-Yo that has at least two more string separators compared to a standard Yo-Yo to accommodate a return string that is held by the finger of the operator. To have a long lasting tuned motion, the two side lengths of the return string in this embodiment may be the same. The positioning of the string connecting points to the Yo-Yo axel are also symmetric towards the symmetry plane that passes through the center and perpendicular to the Yo-Yo axle. The system of three Yo-Yos in series may require at least two unconventional Yo-Yos with multiple string separators and a standard Yo-Yo. A balancing technique may be provided via a return string that connects the two non-standard Yo-Yos. The technique may provide a long lasting and balanced motion.

Figure 1B:
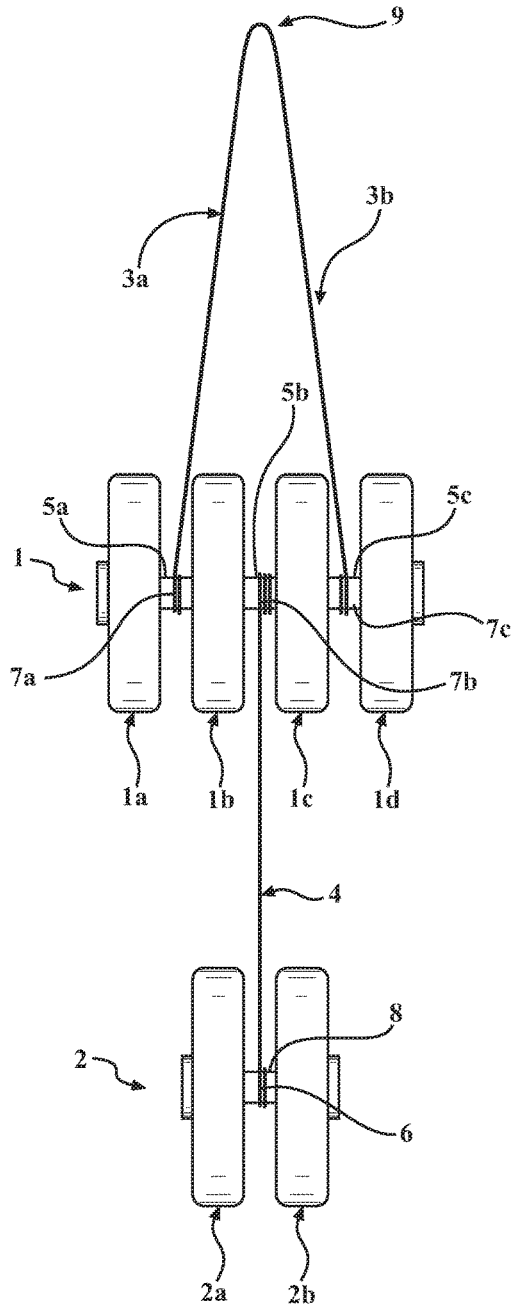
FIG. 1B presents the same embodiment of FIG. 1 with extra weights that may be added symmetrically on both sides to change the Yo-Yos moment of inertia and affect overall rotational-translational-oscillatory motion.

FIG. 1 represents a preferred embodiment of the invention. An unconventional Yo-Yo 1 is connected to a conventional Yo-Yo 2 via a string 4, whereas the return string 3 realizes the connection between Yo-Yo 1 and the operator's hand. Unconventional Yo-Yo 1 is composed by four disks 1*a*, 1*b*, 1*c*, 1*d*. The side disks 1*a*, 1*d* may have the same shapes as the parts of the conventional Yo-Yos. The central disks 1*b* and 1*c* play the role of string separators to create a return string preferably with equal lengths 3*a*, 3*b*. Disks 1*a*, 1*b*, 1*c*, 1*d* define also a triple segmented axle 5 with the respective axle segments 5*a*, 5*b*, 5*c*. 7*a* and 7*c* presents the wrapped parts of string lengths 3*a*, 3*b*, around axles 5*a*, 5*b*. The string lengths 3*a*, 3*b* may be wrapped or unwrapped around axle segments 5*a*, 5*c*. The two central disks confine the central axle segment 5*b*. 7*b* is the wrapped part of string 4 around axle 5*b*. In this embodiment, the other end of string 4 is wrapped around axle 6 of the conventional Yo-Yo 2. Yo-Yo 2 and the disks 2*a*, 2*b* may have any conventional Yo-Yos shapes. 8 shows the wrapped part of string 4 around the axle 6 that belongs to second Yo-Yo. During the operation, the opposite ends of string 4 may be wrapped or unwrapped around two different Yo-Yo axels simultaneously and the windings can be in the same (both clockwise and counterclockwise) or opposite (one clockwise and the other counterclockwise).

Figure 2:
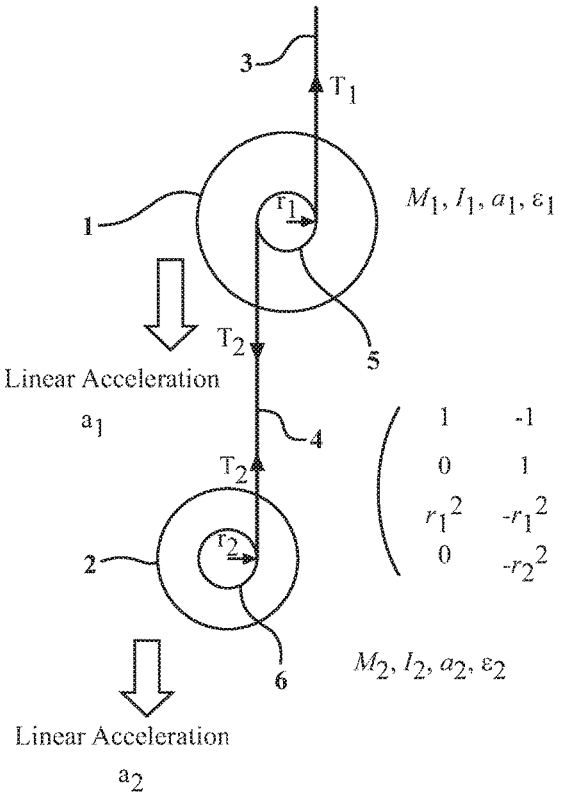
FIG. 2 presents a side view of the embodiment presented in FIG. 1, which depicts the kinematics, dynamics and the system of the forces that act on the Yo-Yos in motion through Newton's laws and equations.

FIG. 2 presents a profile of the embodiment depicted in FIG. 1, and depicts the kinematics and dynamics for one use case. In FIG. 2, a unconventional Yo-Yo 1 is connected to the operator's hand through the return string 3. String 4 connects Yo-Yo 1 and Yo-Yo 2. Forces of tension T1 and T2 span respectively strings 3 and 4. Also depicted are the dynamics and kinematics quantities, mass, moment of inertia, linear acceleration, angular acceleration M1, I1, a1, $\epsilon$1 and M2, I2, a2, $\epsilon$2 for respectively Yo-Yo 1 and Yo-Yo 2. Moment of inertia characterizes the distribution of mass along the Yo-Yo disk radius. It depends also on Yo-Yo shape. We also introduce radiuses r1, r2 for respectively Yo-Yo 1 axle 5 and Yo-Yo 2 axle 6 where the strings wrapping or unwrapping occurs. The string 4 may be wrapped or unwrapped simultaneously on both ends. Four equations (two for each Yo-Yo) are shown for linear and angular motion. The matrix relation in FIG. 2 relates T1, T2, a1 and a2 to easy measured quantities M1, M2, I1, I2, r1, r2. The equations shown are written for a simple use case of interacting Yo-Yos and for the moment that both are moving vertically down. However, even this simple model can give at least qualitative relations between Yo-Yo accelerations and their masses, moments of inertia and axle radiuses. Choosing the approximate length of the strings assists in providing for a long operation of the system. The accelerations and string tensions are highly dependent on the motion of the operator hand. It should be noted that the model calculations presented here can explain the system comprised by two interacting Yo-Yos behavior only qualitatively and during only a limited time interval. A complete and exact solution for the system here presented is not fully described.

Figure 3:
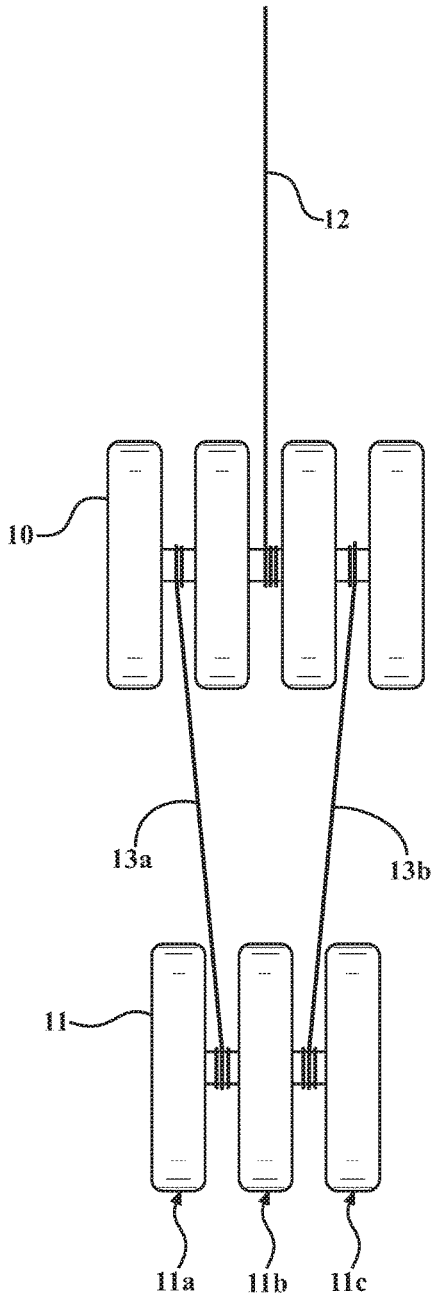
FIG. 3 presents another embodiment of the system of two coupled Yo-Yo's where the strings are reversed. Both Yo-Yo's may be unconventional. The first is a simple string and has one end connected to the central axle of the first Yo-Yo and the other end held by the operator's hand. In this embodiment the two Yo-Yos are connected via a return string.

FIG. 3 shows another embodiment of the system of two coupled Yo-Yos. In this embodiment, Yo-Yo 10 and Yo-Yo 11 are both unconventional and connected through a return string 13 with lengths 13*a* and 13*b*. Yo-Yo 10 has the same general structure as Yo-Yo 1 in FIG. 1. The difference is that the connecting string 12 to the operator's is a simple string and not a return string. The other end of the string 12 can be wrapped or unwrapped at the central segment axle of Yo-Yo 10. Yo-Yo 11 is also unconventional but with two axle segments. Both are connected through the return string 13. For a smooth and long operation it is important for the length 13*a* and 13*b* to be the same. It will also minimize the Yo-Yo precession around the vertical axis allowing the skilled operator to perform many other tricks.

Figure 4:
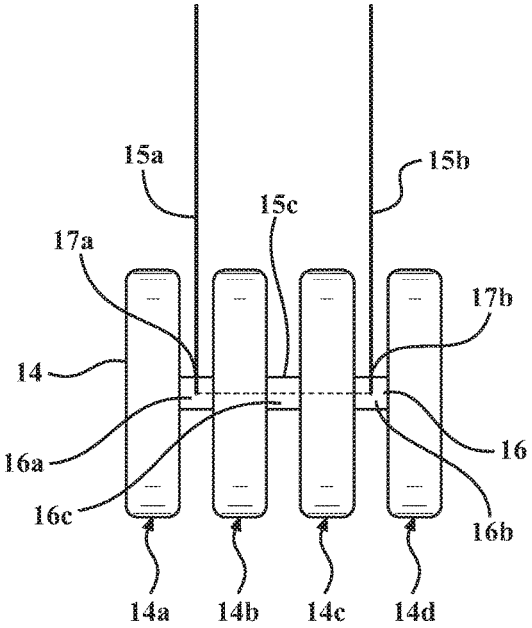
FIG. 4 shows a front view of the spring length regulating mechanism to minimize the unwanted precession

FIG. 4 shows a technique that can be used for an automatic balancing of the string lengths during the performing. Yo-Yo 14 is again a unconventional with two extra string separators 14*b* and 14*c* that define three axle segments 16*a*, 16*b* and 16*c* on the same mounting axle 16. Instead of connecting the part 15*a* of string 15 to axle segment 16*a*, the string passes through hole 17*a* through the axle 16, whose central part is removed. The string comes out through hole 17*b* making therefore, the portion 15*c* of the string 15 to remain inside the hollow part of axle 16. During the operation of multi Yo-Yo system the explained device and mechanism can auto regulate and make both lengths 15*a* and 15*c* equal, providing a smooth and controlled operation and without the gyroscopic precession.

Figure 5:
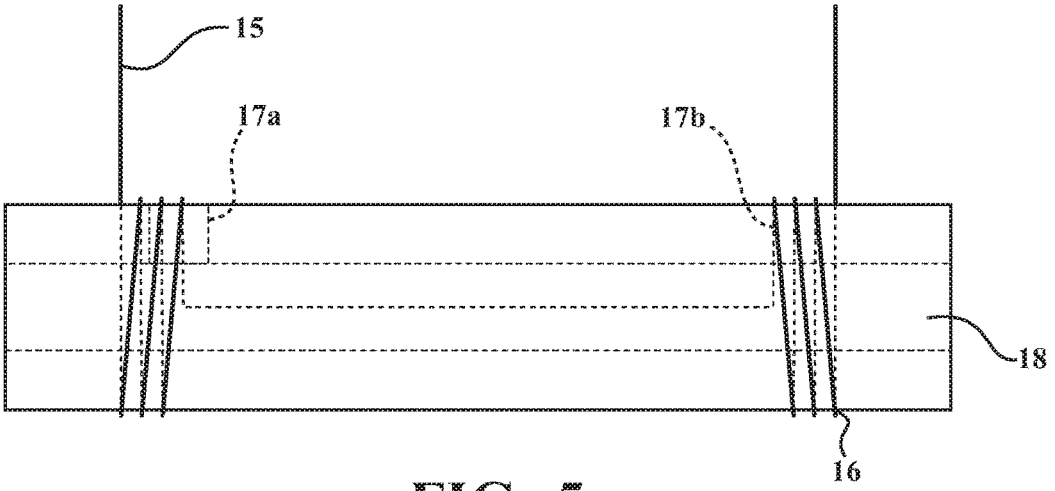
FIG. 5 presents a front view of the Yo-Yo axle, including the holes and the string for the length regulating mechanism.
Figure 6:
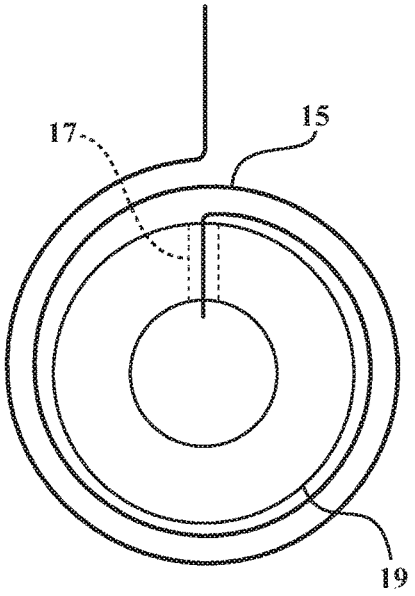
FIG. 6 presents a side view of the embodiment shown in FIG. 5.

Additional details of the mechanism are shown in FIG. 5, which depicts a front view of only axle 16 of unconventional Yo-Yo. Holes 17*a* and 17*b* connect the outside surface of axle 16 with the inside hollow 18. String 15 can be wrapped or unwrapped around the outside surface. During the multiple Yo-Yo system operation, when the return string 15 is completely unwrapped, the length 15*a* and 15*b* may be regulated before the new cycle of wrapping starts again. FIG. 6 presents a side view of the axle 16. Again, the string 15 can go through hole 17 and wrapped around the outside surface 19 of axle 16.

Figure 7A:
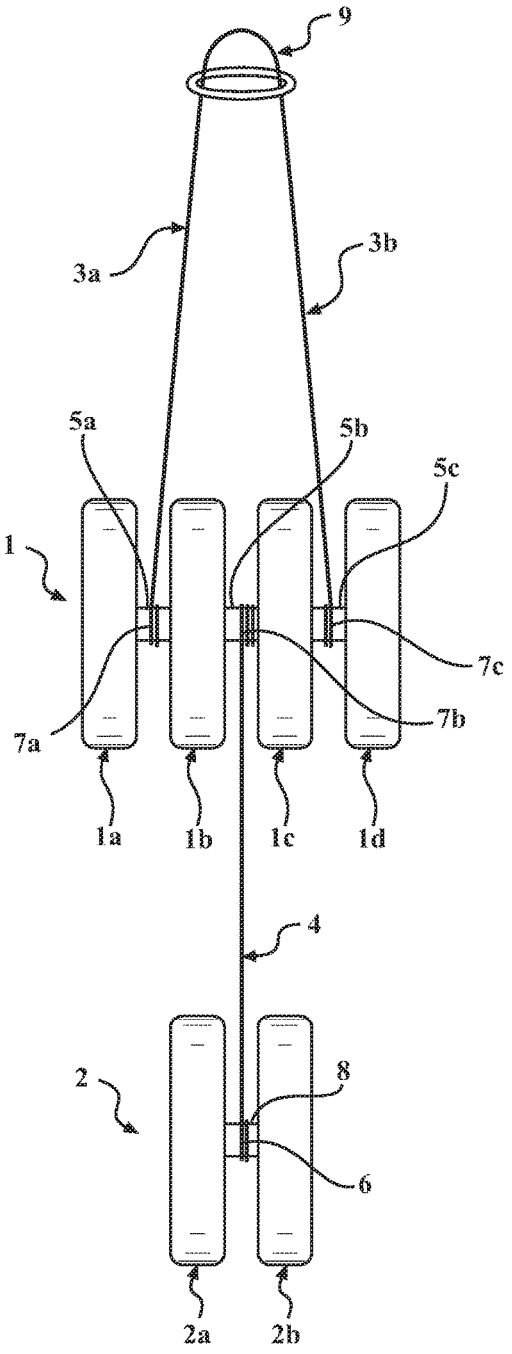
FIG. 7 shows the addition of a ring to the system of two coupled Yo-Yos presented in FIG. 1. The ring keeps the two sides of the return string in proximity. It provides also another way to keep their length equal and enhance the stability of the system during the operation.
Figure 7B:
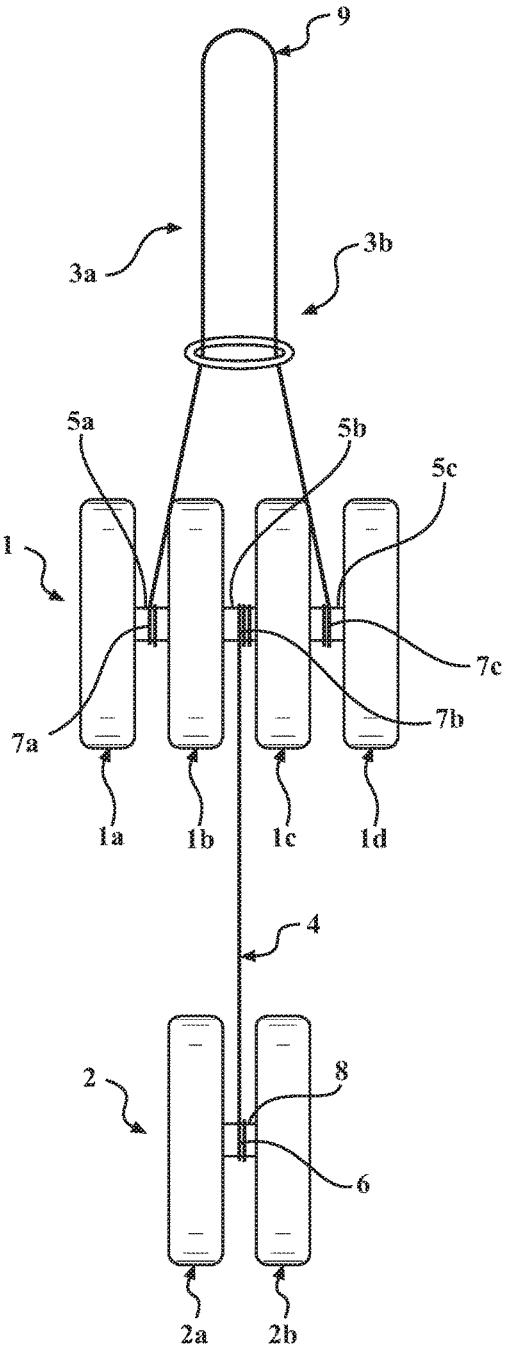

In embodiments, another device for balancing the two lengths of the return string may be a simple ring that can be of any material and be lightweight. FIG. 7 presents such a modification in the system of two interacting Yo-Yos, as shown in FIG. 1. Experiments on prototypes demonstrate that the addition of the ring keeps the two sides of the return ring in equal length and proximity and therefore, can enhance the stability of operation.

Figure 8:
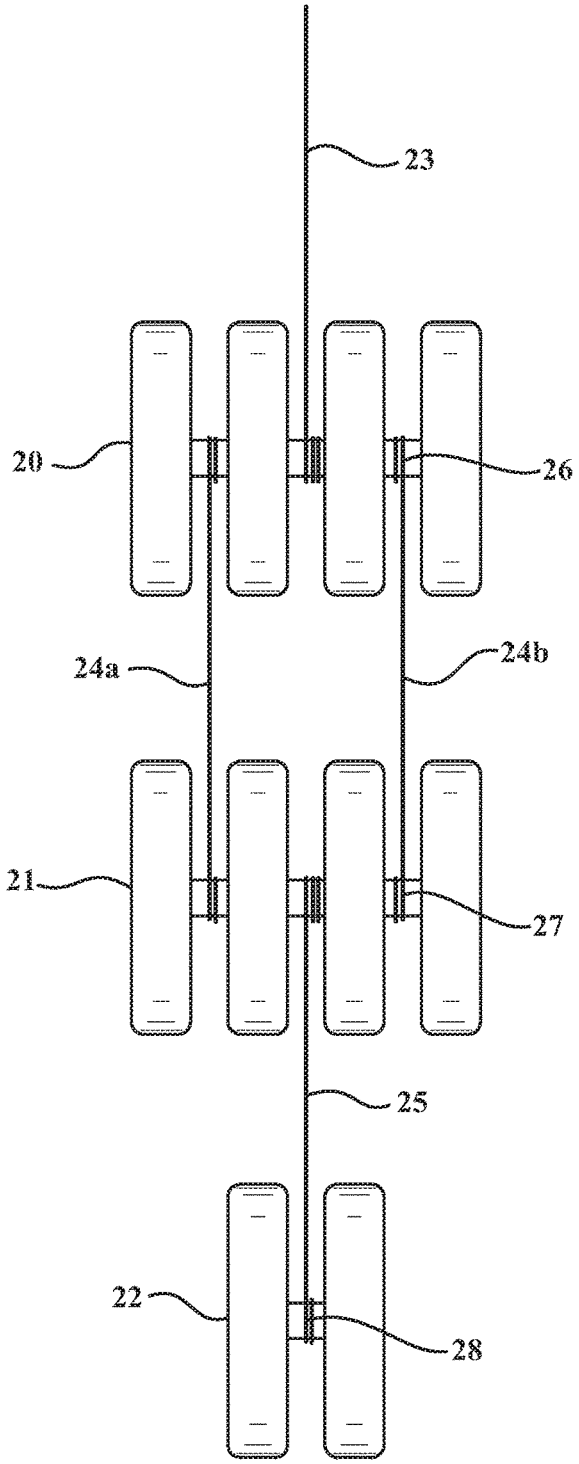
FIG. 8 is an embodiment of the system of three coupled Yo-Yo's in series, comprised by two unconventional Yo-Yos connected via a return string. The third Yo-Yo in the series is conventional.

In embodiments, similar principles as previously disclosed herein may be applied on more complicated Yo-Yo systems. For example, FIG. 8 presents an embodiment of three interacting Yo-Yos. In this example, Yo-Yo 20 and Yo-Yo 21 are unconventional and coupled through a return string 24 with lengths 24*a*, 24*b*. The auto-regulating mechanism may be employed to provide equal length and avoid the gyroscopic precession during the operation. Yo-Yo 22 is conventional and connected to Yo-Yo 21 through string 25. String 25 may be wrapped or unwrapped on both ends around axle 27 of Yo-Yo 21 and axle 28 of Yo-Yo 22 simultaneously. The same may be true for string 24 around axles 26, 27 of Yo-Yos 20 and 21, respectively, whereas, string 23 connects Yo-Yo 20 to the operator's hand. As in the case of two Yo-Yos, the system of three may be set in motion and tuned for a particular choice of strings 23, 24, 25 lengths, depending on the Yo-Yo masses.

Figure 9A:
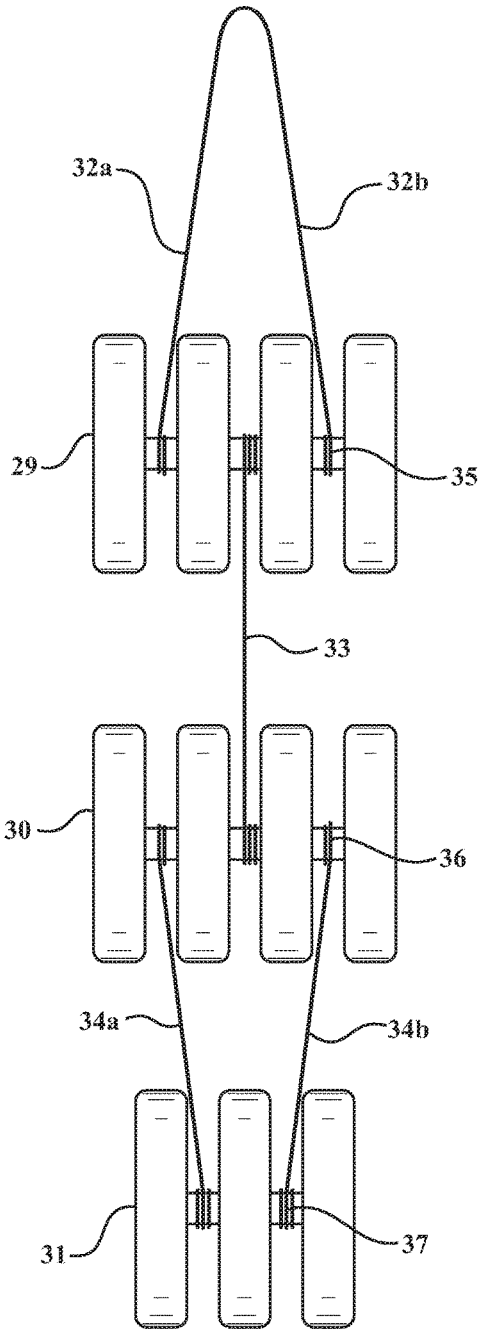
FIG. 9A presents another embodiment of the system of three coupled Yo-Yo's realized with three unconventional Yo-Yos.

FIG. 9A presents another embodiment of the system of three Yo-Yos 29, 30, 31, each of them unconventional. String 32 is a return string with one end that may be wrapped or unwrapped on axle 35 and the other end at the operator's hand. String 33 may be wrapped or unwrapped around axles 35 and 36 of Yo-Yo 29 and Yo-Yo 30. Axles 36 and 37 of Yo-Yo 30 and Yo-Yo 31 are coupled through the return string 24.

Figure 9B:
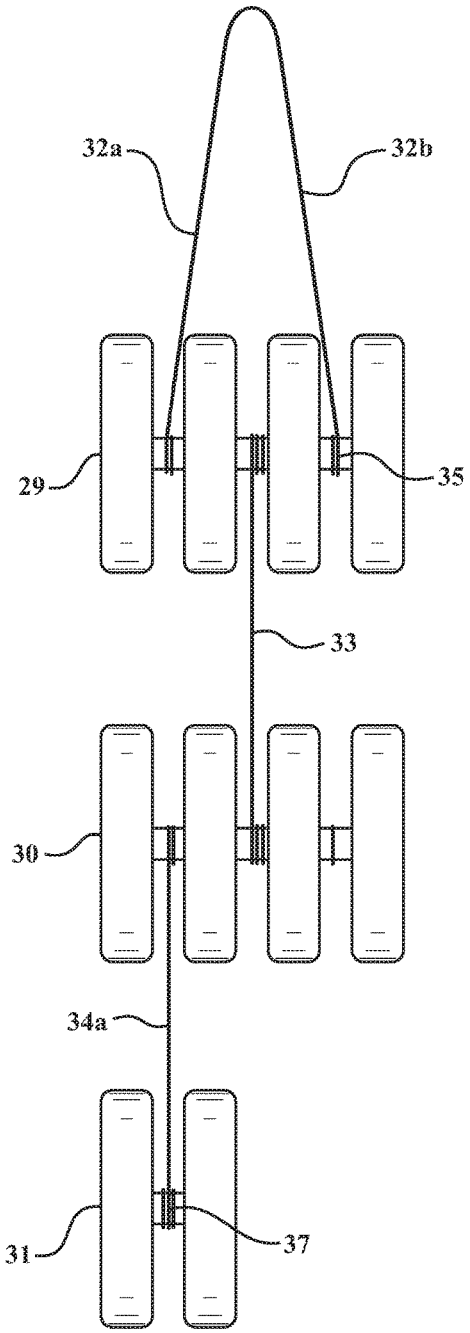
FIG. 9B presents another embodiment of the system having two unconventional Yo-Yos coupled to a conventional Yo-Yo.

FIG. 9B presents another embodiment of the system having two unconventional Yo-Yos coupled to a conventional Yo-Yo. In this embodiment, unconventional Yo-Yo 29 and 30 are coupled to a conventional Yo-Yo 31. Yo-Yo 31 may be configured to be coupled to either of the side axle segments of Yo-Yo 30.

Figure 10:
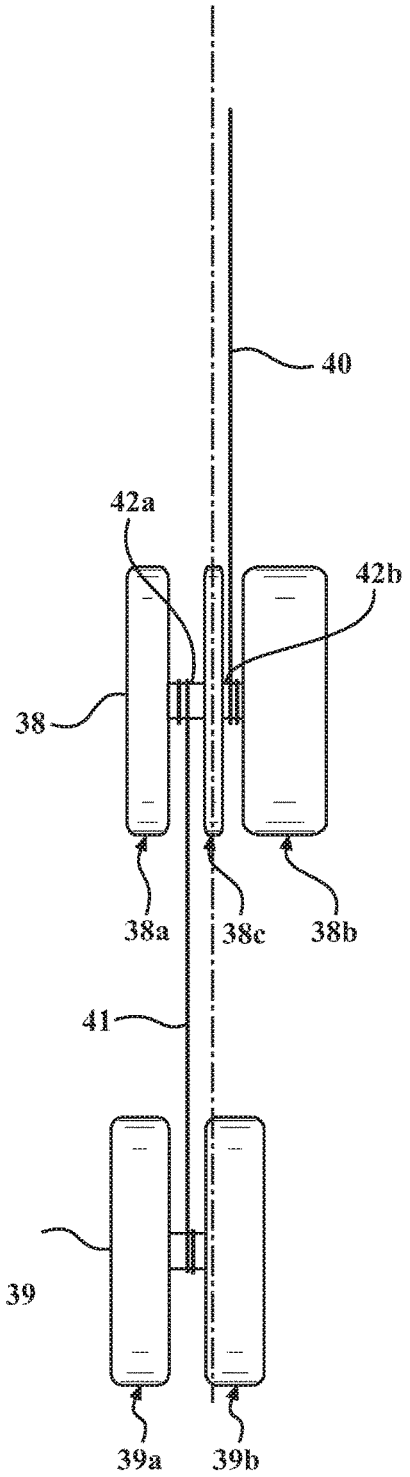
FIG. 10 shows an embodiment of the system of two coupled Yo-Yos via simple strings. The top Yo-Yo is unconventional and non-symmetric. The string separator in the top Yo-Yo is thin and the two strings are very near the center of mass plane. In this embodiment the bottom Yo-Yo is conventional.

In another embodiment, symmetric and asymmetric parts may be used to avoid the use of return strings without compromising the operation of the system may comprise the system of interacting Yo-Yos. The symmetry here is defined by the symmetry plane perpendicular at the center to the Yo-Yo axle. FIG. 10 presents two Yo-Yos coupled via the same principles as described herein. In particular, in this embodiment Yo-Yo 38 is comprised by different weight disks 38*a*, 38*b* and 38*c*. Disk 38*c* as a string separator and defines the segment axles 42*a*, 42*b* and is preferred to be thin and relatively light. Whereas the side disk 38*b* is preferred to be heavier to counter balance the combine weight of disks 38*a* and 38*c* on both sides of the plane that goes through the system center of mass and with the trace defined by dashed line 43. One side end of the simple string 40 is held by the operator and the other end can be wrapped and unwrapped around a segment axle 42*b*. For an easy operation, the contact point of string 40 with the axle is preferred to be very near the center of mass trace, therefore dashed line 43 is presented. In this embodiment, Yo-Yo 39 is conventional and comprised by the same disks 39*a*, 39*b*. One end of string 41 is wrapped or unwrapped around segment axle 42*a* of Yo-Yo 38 and the other end is wrapped or unwrapped around Yo-Yo 39 axle. In this embodiment both strings 40 and 41 are simple and string 41 can be wrapped and unwrapped simultaneously around axles that belong to different Yo-Yos 38, 39. A skillful operator may keep the center of mass of the system near or in the same vertical plane going through operator finger.

Figure 11:
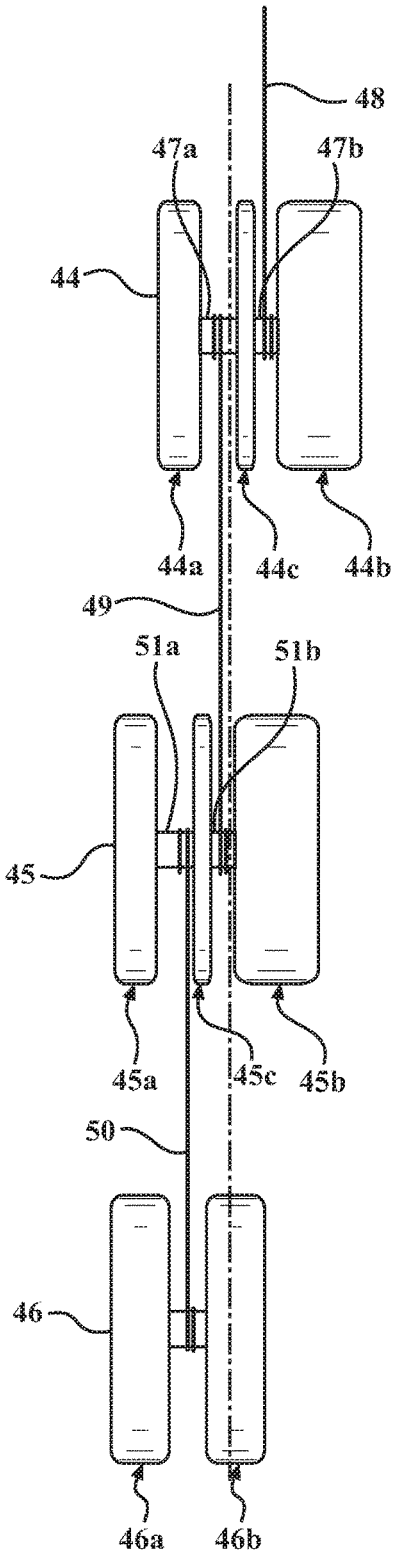
FIG. 11 shows an embodiment of the system of three Yo-Yos coupled via simple strings. The top two Yo-Yos are unconventional and asymmetric and the bottom Yo-Yo conventional.

In another embodiment, an additional Yo-Yo may be added to create a system of three interacting Yo-Yos via simple strings. FIG. 11 presents this embodiment. Yo-Yos 44, 45 are not symmetric and are connected via a simple string 49. Another simple string 50 connects Yo-Yo 45 with Yo-Yo 46. The system may be set and kept in motion along the vertical trace of center of mass plane, which is represented by the dashed line 51.

In the above described embodiments, the Yo-Yos are illustrated to be coupled to various axles segments of adjacent Yo-Yos. It should be noted that in other embodiments, different variations of coupling the Yo-Yos may be used. For example, in embodiment, one Yo-Yo may be coupled to a first side axle segment and in another embodiment, the same Yo-Yo may be coupled a second side axle segment rather than the first.

In embodiments, the yo-yo embodiments described herein may contain or be in communication with at least one sensor, which will hereinafter be referred to as sensors. Sensors, and the locations of such sensors, may vary based on the particular parameter being detected. Sensor types used in the yo-yo and/or associated with the yo-yo may include, but are not limited to, off-the-shelf sensors, accelerometer, magnetometer, gyroscope, microphone, light monitor, tension monitor, strain gauge, or some other type of gauge, monitor or sensor, including wearable devices. The sensors may be in communication with a software application, for example through a wireless communication means, including but not limited to Bluetooth, near field communication, or some other means. The software application may operate on a mobile device, including but not limited to a smart phone, laptop computer, tablet computer, or some other type of mobile device. The software application may receive data from the sensors associated with a Yo-Yo and store and present data visualizations of the performance of the Yo-Yo, including but not limited to the number of repetitions a user achieves, the speed of operation, or some other type of data related to the performance of the Yo-Yo. Such data may be shared, for example through social media platforms, and competitions with other users initiated and recorded, such as competitions for the length of uninterrupted use, speed of Yo-Yo operation, or some other criterion.

While only a few embodiments of the present disclosure have been shown and described, it will be obvious to those skilled in the art that many changes and modifications may be made thereunto without departing from the spirit and scope of the present disclosure as described in the following claims. All patent applications and patents, both foreign and domestic, and all other publications referenced herein are incorporated herein in their entireties to the full extent permitted by law.

The methods and systems described herein may be deployed in part or in whole through a machine that executes computer software, program codes, and/or instructions on a processor. The processor may be part of a server, client, network infrastructure, mobile computing platform, stationary computing platform, or other computing platform. A processor may be any kind of computational or processing device capable of executing program instructions, codes, binary instructions and the like. The processor may be or include a signal processor, digital processor, embedded processor, microprocessor or any variant such as a co-processor (math co-processor, graphic co-processor, communication co-processor and the like) and the like that may directly or indirectly facilitate execution of program code or program instructions stored thereon. In addition, the processor may enable execution of multiple programs, threads, and codes. The threads may be executed simultaneously to enhance the performance of the processor and to facilitate simultaneous operations of the application. By way of implementation, methods, program codes, program instructions and the like described herein may be implemented in one or more thread. The thread may spawn other threads that may have assigned priorities associated with them; the processor may execute these threads based on priority or any other order based on instructions provided in the program code. The processor may include memory that stores methods, codes, instructions and programs as described herein and elsewhere. The processor may access a storage medium through an interface that may store methods, codes, and instructions as described herein and elsewhere. The storage medium associated with the processor for storing methods, programs, codes, program instructions or other type of instructions capable of being executed by the computing or processing device may include but may not be limited to one or more of a CD-ROM, DVD, memory, hard disk, flash drive, RAM, ROM, cache and the like.

A processor may include one or more cores that may enhance speed and performance of a multiprocessor. In embodiments, the process may be a dual core processor, quad core processors, other chip-level multiprocessor and the like that combine two or more independent cores (called a die).

The methods and systems described herein may be deployed in part or in whole through a machine that executes computer software on a server, client, firewall, gateway, hub, router, or other such computer and/or networking hardware. The software program may be associated with a server that may include a file server, print server, domain server, internet server, intranet server and other variants such as secondary server, host server, distributed server and the like. The server may include one or more of memories, processors, computer readable transitory and/or non-transitory media, storage media, ports (physical and virtual), communication devices, and interfaces capable of accessing other servers, clients, machines, and devices through a wired or a wireless medium, and the like. The methods, programs or codes as described herein and elsewhere may be executed by the server. In addition, other devices required for execution of methods as described in this application may be considered as a part of the infrastructure associated with the server.

The server may provide an interface to other devices including, without limitation, clients, other servers, printers, database servers, print servers, file servers, communication servers, distributed servers and the like. Additionally, this coupling and/or connection may facilitate remote execution of program across the network. The networking of some or all of these devices may facilitate parallel processing of a program or method at one or more location without deviating from the scope of the disclosure. In addition, all the devices attached to the server through an interface may include at least one storage medium capable of storing methods, programs, code and/or instructions. A central repository may provide program instructions to be executed on different devices. In this implementation, the remote repository may act as a storage medium for program code, instructions, and programs.

The software program may be associated with a client that may include a file client, print client, domain client, internet client, intranet client and other variants such as secondary client, host client, distributed client and the like. The client may include one or more of memories, processors, computer readable transitory and/or non-transitory media, storage media, ports (physical and virtual), communication devices, and interfaces capable of accessing other clients, servers, machines, and devices through a wired or a wireless medium, and the like. The methods, programs or codes as described herein and elsewhere may be executed by the client. In addition, other devices required for execution of methods as described in this application may be considered as a part of the infrastructure associated with the client.

The client may provide an interface to other devices including, without limitation, servers, other clients, printers, database servers, print servers, file servers, communication servers, distributed servers and the like. Additionally, this coupling and/or connection may facilitate remote execution of program across the network. The networking of some or all of these devices may facilitate parallel processing of a program or method at one or more location without deviating from the scope of the disclosure. In addition, all the devices attached to the client through an interface may include at least one storage medium capable of storing methods, programs, applications, code and/or instructions. A central repository may provide program instructions to be executed on different devices. In this implementation, the remote repository may act as a storage medium for program code, instructions, and programs.

The methods and systems described herein may be deployed in part or in whole through network infrastructures. The network infrastructure may include elements such as computing devices, servers, routers, hubs, firewalls, clients, personal computers, communication devices, routing devices and other active and passive devices, modules and/or components as known in the art. The computing and/or non-computing device(s) associated with the network infrastructure may include, apart from other components, a storage medium such as flash memory, buffer, stack, RAM, ROM and the like. The processes, methods, program codes, instructions described herein and elsewhere may be executed by one or more of the network infrastructural elements.

The methods, program codes, and instructions described herein and elsewhere may be implemented on a cellular network having multiple cells. The cellular network may either be frequency division multiple access (FDMA) network or code division multiple access (CDMA) network. The cellular network may include mobile devices, cell sites, base stations, repeaters, antennas, towers, and the like.

The methods, programs codes, and instructions described herein and elsewhere may be implemented on or through mobile devices. The mobile devices may include navigation devices, cell phones, mobile phones, mobile personal digital assistants, laptops, palmtops, netbooks, pagers, electronic books readers, music players and the like. These devices may include, apart from other components, a storage medium such as a flash memory, buffer, RAM, ROM and one or more computing devices. The computing devices associated with mobile devices may be enabled to execute program codes, methods, and instructions stored thereon. Alternatively, the mobile devices may be configured to execute instructions in collaboration with other devices. The mobile devices may communicate with base stations interfaced with servers and configured to execute program codes. The mobile devices may communicate on a peer to peer network, mesh network, or other communications network. The program code may be stored on the storage medium associated with the server and executed by a computing device embedded within the server. The base station may include a computing device and a storage medium. The storage device may store program codes and instructions executed by the computing devices associated with the base station.

The computer software, program codes, and/or instructions may be stored and/or accessed on machine readable transitory and/or non-transitory media that may include: computer components, devices, and recording media that retain digital data used for computing for some interval of time; semiconductor storage known as random access memory (RAM); mass storage typically for more permanent storage, such as optical discs, forms of magnetic storage like hard disks, tapes, drums, cards and other types; processor registers, cache memory, volatile memory, non-volatile memory; optical storage such as CD, DVD; removable media such as flash memory (e.g. USB sticks or keys), floppy disks, magnetic tape, paper tape, punch cards, standalone RAM disks, Zip drives, removable mass storage, off-line, and the like; other computer memory such as dynamic memory, static memory, read/write storage, mutable storage, read only, random access, sequential access, location addressable, file addressable, content addressable, network attached storage, storage area network, bar codes, magnetic ink, and the like.

The methods and systems described herein may transform physical and/or or intangible items from one state to another. The methods and systems described herein may also transform data representing physical and/or intangible items from one state to another.

The elements described and depicted herein, including in flow charts and block diagrams throughout the figures, imply logical boundaries between the elements. However, according to software or hardware engineering practices, the depicted elements and the functions thereof may be implemented on machines through computer executable transitory and/or non-transitory media having a processor capable of executing program instructions stored thereon as a monolithic software structure, as standalone software modules, or as modules that employ external routines, code, services, and so forth, or any combination of these, and all such implementations may be within the scope of the present disclosure. Examples of such machines may include, but may not be limited to, personal digital assistants, laptops, personal computers, mobile phones, other handheld computing devices, medical equipment, wired or wireless communication devices, transducers, chips, calculators, satellites, tablet PCs, electronic books, gadgets, electronic devices, devices having artificial intelligence, computing devices, networking equipment, servers, routers and the like. Furthermore, the elements depicted in the flow chart and block diagrams or any other logical component may be implemented on a machine capable of executing program instructions. Thus, while the foregoing drawings and descriptions set forth functional aspects of the disclosed systems, no particular arrangement of software for implementing these functional aspects should be inferred from these descriptions unless explicitly stated or otherwise clear from the context. Similarly, it will be appreciated that the various steps identified and described above may be varied, and that the order of steps may be adapted to particular applications of the techniques disclosed herein. All such variations and modifications are intended to fall within the scope of this disclosure. As such, the depiction and/or description of an order for various steps should not be understood to require a particular order of execution for those steps, unless required by a particular application, or explicitly stated or otherwise clear from the context.

The methods and/or processes described above, and steps thereof, may be realized in hardware, software or any combination of hardware and software suitable for a particular application. The hardware may include a dedicated computing device or specific computing device or particular aspect or component of a specific computing device. The processes may be realized in one or more microprocessors, microcontrollers, embedded microcontrollers, programmable digital signal processors or other programmable device, along with internal and/or external memory. The processes may also, or instead, be embodied in an application specific integrated circuit, a programmable gate array, programmable array logic, or any other device or combination of devices that may be configured to process electronic signals. It will further be appreciated that one or more of the processes may be realized as a computer executable code capable of being executed on a machine readable medium.

The computer executable code may be created using a structured programming language such as C, an object oriented programming language such as C++, or any other high-level or low-level programming language (including assembly languages, hardware description languages, and database programming languages and technologies) that may be stored, compiled or interpreted to run on one of the above devices, as well as heterogeneous combinations of processors, processor architectures, or combinations of different hardware and software, or any other machine capable of executing program instructions.

Thus, in one aspect, each method described above and combinations thereof may be embodied in computer executable code that, when executing on one or more computing devices, performs the steps thereof. In another aspect, the methods may be embodied in systems that perform the steps thereof, and may be distributed across devices in a number of ways, or all of the functionality may be integrated into a dedicated, standalone device or other hardware. In another aspect, the means for performing the steps associated with the processes described above may include any of the hardware and/or software described above. All such permutations and combinations are intended to fall within the scope of the present disclosure.

While the disclosure has been disclosed in connection with the preferred embodiments shown and described in detail, various modifications and improvements thereon will become readily apparent to those skilled in the art. Accordingly, the spirit and scope of the present disclosure is not to be limited by the foregoing examples, but is to be understood in the broadest sense allowable by law.

What is claimed is:

1. A system of Yo-Yos comprising:

a first Yo-Yo having a first disk, a second disk, third disk, and a fourth disk, the first, second, third and fourth disks being spaced apart from one another by a first axle segment, a second axle segment and a third axle segment;

a second Yo-Yo having a first disk and a second disk separated by a central axle segment, the second Yo-Yo is spaced apart from the first Yo-Yo;

a first string having a first end and a second end, the first end coupled to the first axle segment of the first Yo-Yo and the second end is coupled to the third axle segment, wherein a portion of the first string between the first end and the second end is configured to be held by a user; and a second string having a first end and second end, the first end of the second string is coupled to the second axle segment of the first Yo-Yo and the second end of the second string is coupled to the central axle segment of the second Yo-Yo, wherein, during operation, the first end of the second string wraps or unwraps around the second axle segment of the first Yo-Yo, and wherein, during operation, the second end of the second string wraps or unwraps around the central axle segment of the second Yo-Yo, arising from a driving oscillatory motion of the user's hand being transferred sequentially to the system of Yo-Yos when the frequency of the driving oscillatory motion of the user's hand coincides with intrinsic frequencies of the system of Yo-Yos, wherein the intrinsic frequencies of the system of Yo-Yos depends at least on the first and second Yo-Yos moments of inertia, wherein the first string and the second string are coupled to first and second Yo-Yos so that the first and second Yo-Yos may rotate to cause linear and angular movement.

2. The system of claims 1, wherein the first string is wrapped around the first axle segment and the third axle segment.

3. The system of claim 1, wherein the first end of the second string is wrapped around the second axle segment of the first Yo-Yo and the second end of the second string is wrapped around the central axle segment of the second Yo-Yo.

4. The system of claim 1, wherein the movement of the first and second Yo-Yos occur simultaneously.

5. The system of claim 1, wherein a length of the first and second strings are equal.

6. The system of claim 1, wherein a length of the first string is greater than the second string.

7. The system of claims 1, wherein a weight of the first and second Yo-Yos are equal.

8. The system of claim 1, wherein a weight of the first Yo-Yo is greater than the second Yo-Yo.

9. The system of claim 1, wherein an acceleration and a rotational velocity of the first, and second Yo-Yos is not the same.

10. A system of Yo-Yos comprising:

a first Yo-Yo having a first disk, a second disk, third disk, and a fourth disk, the first, second, third and fourth disks being spaced apart from one another by a first axle segment, a second axle segment and a third axle segment;

a second Yo-Yo having a first disk, second disk, and a third disk separated by a first axle segment, and a second axle segment, wherein the second Yo-Yo is spaced apart from the first Yo-Yo;

a first string having a first end and a second end, the first end of the first string is coupled to the first axle segment of the first Yo-Yo and the second end is coupled to the first axle segment of the second Yo-Yo, wherein, during operation, the first end of the first string wraps or unwraps around the first axle segment of the first Yo-Yo, and wherein, during operation, the second end of the first string wraps or unwraps around the first axles of the second Yo-Yo, arising from a driving oscillatory motion of the user's hand being transferred sequentially to the system of Yo-Yos when the frequency of the driving oscillatory motion of the user's hand coincides with intrinsic frequencies of the system of Yo-Yos, wherein the intrinsic frequencies of the system of Yo-Yos depends on at least the first and second Yo-Yos moments of inertia;

a second string having a first end and second end, the first end of the second string is coupled to the third axle segment of the first Yo-Yo and the second end of the second string is coupled to the second axle segment of the second Yo-Yo, wherein, during operation, the first end of the second string wraps or unwraps around the third axle segment of the first Yo-Yo, and wherein, during operation, the second end of the second string wraps or unwarps around the second axle of the second Yo-Yo, arising from the driving oscillatory motion of the user's hand being transferred sequentially to the system of Yo-Yos when the frequency of the driving oscillatory motion of the user's hand coincides with intrinsic frequencies of the system of Yo-Yos, wherein the intrinsic frequencies of the system of Yo-Yos depends on at least the first and second Yo-Yos moments of inertia; and a third string having a first end and second end, the first end of the third string is coupled to the second axle segment of the first Yo-Yo and the second end of the third string is a free end adapted to be held by a user.

11. The system of claim 10, wherein the first string and the second strings are return strings.

12. The system of claim 10, wherein the first and the second strings have equal lengths.

13. The system of claims 10, wherein the first and second strings are adapted to be wound and unwound simultaneously during operation.

14. The system of claim 10, wherein the weight of the first Yo-Yo is greater than the second Yo-Yo.

15. A system of Yo-Yos comprising:

a first Yo-Yo having a first disk, a second disk, third disk, and a fourth disk, the first, second, third and fourth disks being spaced apart from one another by a first axle segment, a second axle segment and a third axle segment;

a second Yo-Yo having a first disk, a second disk, third disk, and a fourth disk, the first, second, third and fourth disks being spaced apart from one another by a first axle segment, a second axle segment and a third axle segment, the second Yo-Yo is spaced apart from the first Yo-Yo;

a third Yo-Yo having a first disk and a second disk separated by a central axle segment, the third Yo-Yo is spaced apart from the second Yo-Yo;

a first string having a first end and a second end, the first end coupled to the first axle segment of the first Yo-Yo and the second end is coupled to the first axle segment of the second Yo-Yo;

a second string having a first end and a second end, the first end coupled to the third axle segment of the first Yo-Yo and the second end is coupled to the third axle segment of the second Yo-Yo;

a third string having a first end and a second end, the first end coupled to the second axle segment of the first Yo-Yo and the second end is a free end configured to be held by a user; and a fourth string having a first end and a second end, the first end of the fourth string coupled to the central axle segment of the third Yo-Yo and the second end of the fourth string is coupled to the second axle segment of the second Yo-Yo, wherein, during operation, the first end of the fourth string wraps or unwraps around the central axle segment of the third Yo-Yo, and wherein, during operation, the second end of the fourth string wraps or unwraps around the second axle segment of the second Yo-Yo, arising from a driving oscillatory motion of the user's hand being transferred sequentially to the system of Yo-Yos when the frequency of the driving oscillatory motion of the user's hand coincides with intrinsic frequencies of the system of Yo-Yos, wherein the intrinsic frequencies of the system of Yo-Yos depends on at least the first, second and third Yo-Yos moments of inertia.

16. The system of claim 15, wherein the first, second, and fourth strings are return strings.

17. The system of claim 15, wherein wrapping and unwrapping of the first, second, and fourth strings occur simultaneously.

18. The system of claim 15, wherein an acceleration and a rotational velocity of the first, second and third Yo-Yos is not the same.

19. The system of claim 15, wherein the length of the first, second, and fourth strings are different.

20. A Yo-Yo comprising:

a first disk, a second disk, third disk, and a fourth disk, the first, second, third and fourth disks being spaced apart from one another by a first axle segment, a second axle segment and a third axle segment;

wherein the first, second, and third axle segments include a hollow inside region extending from the first disk to the fourth disk; and a string adapted to extend through an opening on the surface of the first axle segment extending though the hollow inside region through an opening on the surface of the third axle segment, wherein the first disk, the second disk, the third disk, the fourth, and the string at least partially form a Yo-Yo, and wherein during operation of the Yo-Yo, the string wraps and unwraps around the first axle segment and the third axle segment.

* * * * *